United States Patent [19]

Lohmeyer

[11] Patent Number: 4,856,846

[45] Date of Patent: Aug. 15, 1989

[54] CHAIR WITH A SEAT AND AN INHERENTLY ELASTICALLY PLIABLE BACK REST

[76] Inventor: Hartmut Lohmeyer, Flemingstr. 94A, D-8000 Munich 81, Fed. Rep. of Germany

[21] Appl. No.: 126,128

[22] PCT Filed: Feb. 5, 1987

[86] PCT No.: PCT/DE87/00046

§ 371 Date: Oct. 13, 1987

§ 102(e) Date: Oct. 13, 1987

[87] PCT Pub. No.: WO87/04909

PCT Pub. Date: Aug. 27, 1987

[30] Foreign Application Priority Data

Feb. 13, 1986 [DE] Fed. Rep. of Germany ..... 3604534

[51] Int. Cl.[4] ..... A47C 3/00

[52] U.S. Cl. ..... 297/300; 297/DIG. 2; 297/457

[58] Field of Search ..... 297/300, 284, DIG. 2, 297/294, 296, 297, 457

[56] References Cited

U.S. PATENT DOCUMENTS

| | | | |
|---|---|---|---|
| 1,886,308 | 11/1932 | Schultes | 297/285 |
| 4,333,683 | 6/1982 | Ambasz | 297/300 |
| 4,580,836 | 4/1986 | Verney | 297/296 |
| 4,585,272 | 4/1986 | Ballerini | 297/284 |
| 4,733,910 | 3/1988 | Brennan | 297/300 |

*Primary Examiner*—Francis K. Zugel

[57] ABSTRACT

Chair with a seat and an inherently elastically compliant back rest that consists in the hip area of several transverse ribs separated from one another by interspaces, which are held together by connectors in such a way that the transverse ribs can rotate with respect to one another around horizontal axes, and that the connectors consist of film hinges with rotation-limiting elements bridging over the interspaces, with the seat together with the back rest and together with the transverse ribs being molded in one piece from plastic over continuous cross sections, formed by the film hinges and spring elements associated with them.

9 Claims, 6 Drawing Sheets

Figure 1:
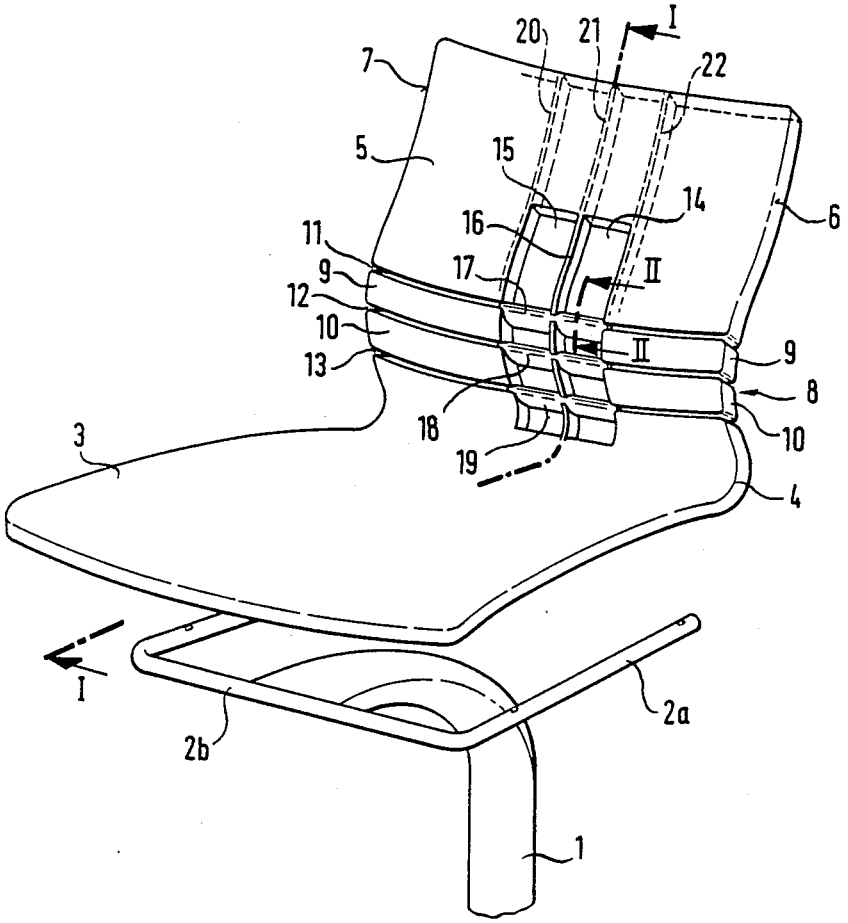

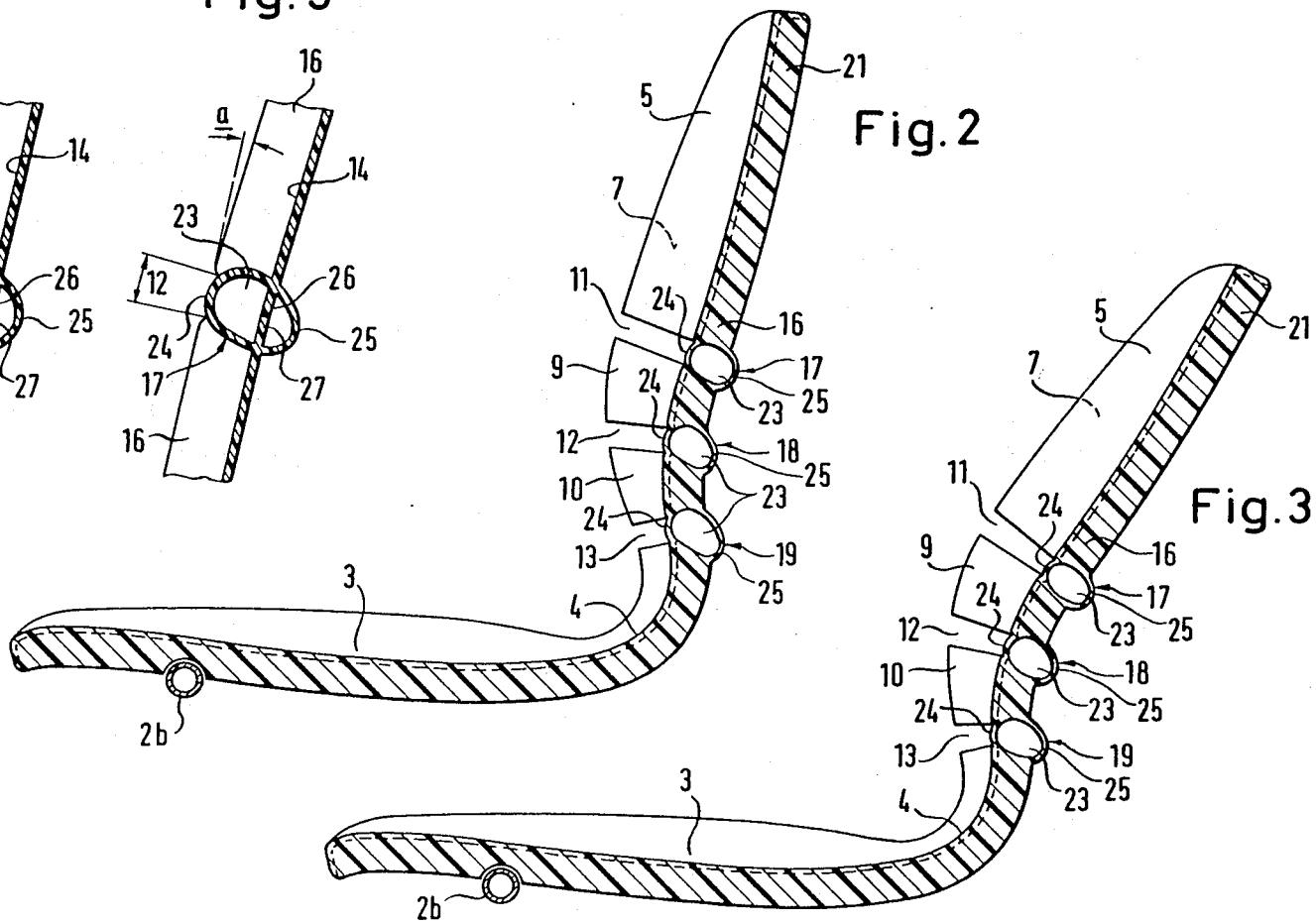
Fig. 3
Fig. 2
21
5
7
11
9
12
10
24
13
4
3
2b
16
17
25
23
18
19
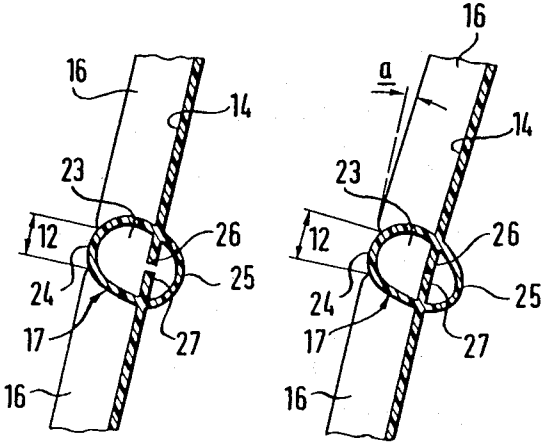
Fig. 5
Fig. 4
14
26
25
27
16
23
12
24
17
a

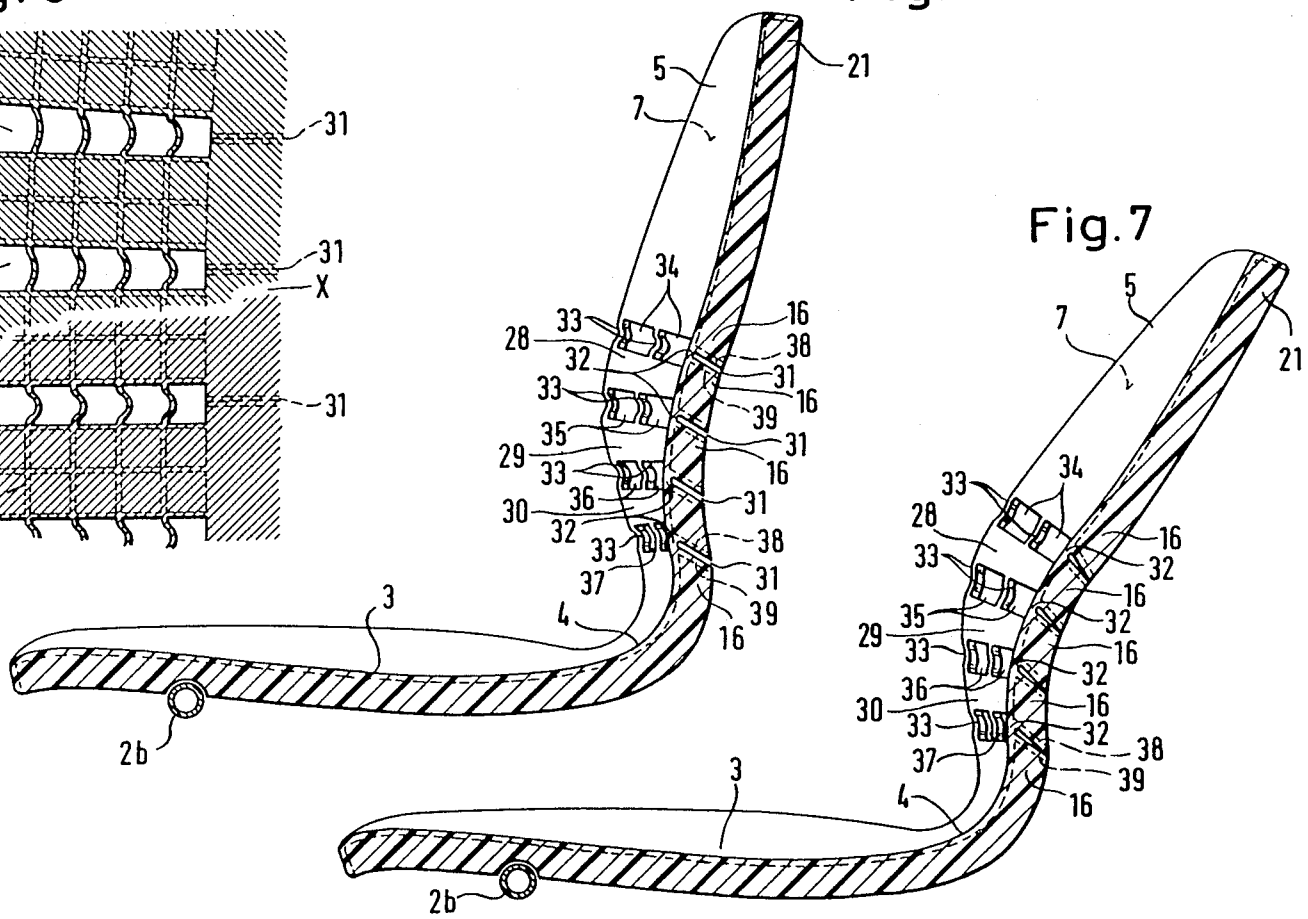
Fig. 7
Fig. 6
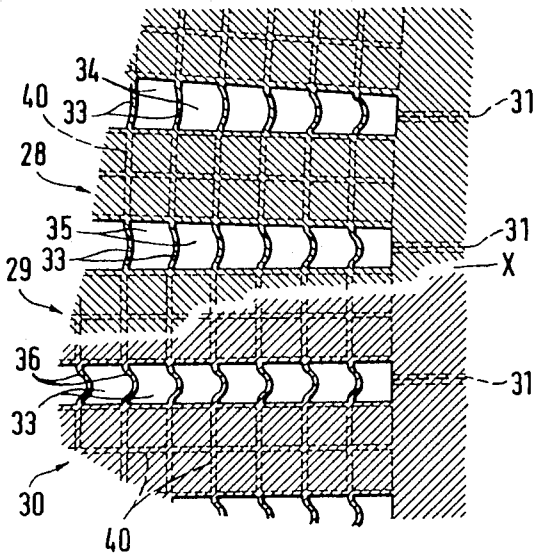
Fig. 8

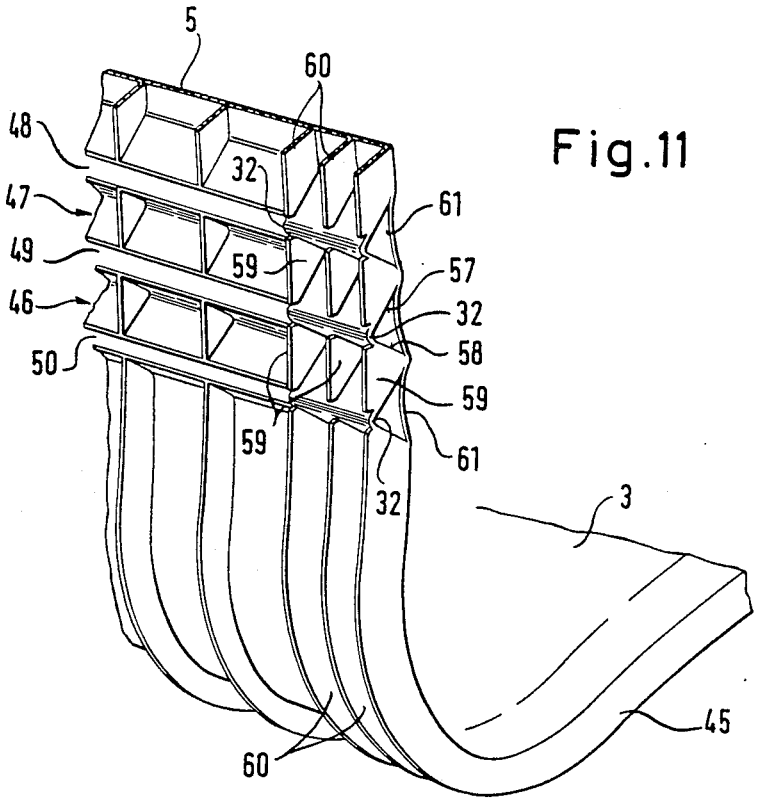
Fig.11
Fig.12
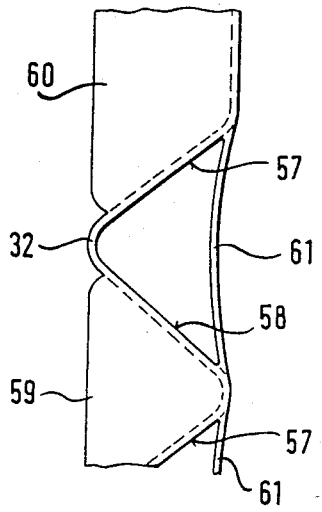
Fig.13
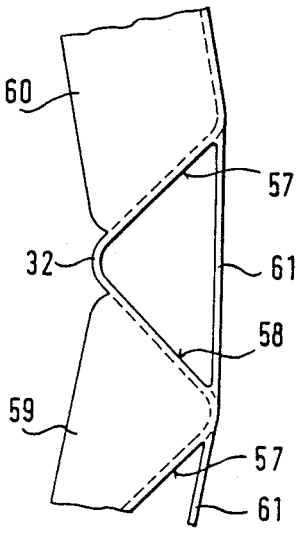

CHAIR WITH A SEAT AND AN INHERENTLY ELASTICALLY PLIABLE BACK REST

This invention concerns a chair with a seat and an inherently elastically pliable back rest that consists roughly in the hip area of several transverse ribs separated from one another by spaces, which are held together by connectors in such a way that the transverse ribs can be rotated with respect to one another around horizontal axes.

Such a chair is shown in European Patent Application No. 107 627. As the drawings of this publication show particularly, it requires a substantial technical effort to produce the known chair in the area of the connectors, especially because of spring elements located in the area of the connectors for which leaf springs are provided in particular. The spring elements introduced separately each require separate technical means for fastening and motion clearance, so that an expensive structural design is produced overall. The possibility is actually pointed out in claim 32 of the mentioned European Patent Application of molding the known chair in one piece from a material in which two leaf springs are embedded, using an embedding material that has to be appropriately flexible. However, this embedding does not reduce the structural expense in the interior of the chair, it merely provides for enclosing the design elements on all sides by the embedding, which has to meet the requirement of having the same mobility as the leaf springs.

The purpose of this invention is to develop a chair of the type of design described initially in such a way that it can be produced at lower structural expense and thus more simply and economically.

The problem is solved by the fact that the connectors consist of film hinges with rotation-limiting elements, bridging over the intermediate spaces in one piece, with the seat being molded in one piece together with the transverse ribs of plastic, over continuous profiles that are formed by the film hinges and spring elements associated with these placed on the arms of the film hinges.

Based on this configuration, there is the possibility of molding the individual elements necessary for the chair in one piece, without the need of any components that have to be embedded in the plastic. This results in a molding process that can be handled directly in production, particularly by injection molding, with important parts of the chair, namely the parts that make possible a rotation of the transverse ribs relative to one another, and the spring elements, being formed by continuous profiles. The plastic bridges between the transverse ribs necessary for the molding from plastic are therefore designed in the form of continuous profiles in such a way that they form important elements of the chair, which makes unnecessary a separate structural incorporation of otherwise required components. This results in a chair that can be manufactured completely mechanically in one operating step with regard to its seat and its back rest.

To produce the back rest, up to approximately three transverse ribs are normally necessary in the hip area of the back rest. Under an ordinary loading of the back rest by a seated person leaning back, angular changes are produced between the individual transverse ribs that are approximately in the range of up to 3°. This results in the film hinges and the spring elements associated with them being exposed to only relatively slight bending and thus mechanical stresses, that can be supported directly by appropriate plastics, such as polypropylene, for example.

The arms of the film hinges suitably change smoothly into the back rest and the transverse ribs. In this case, the spring elements are directly coactuated with the motion of the film hinges.

A suitable design of the film hinges with the spring elements is provided when they are designed as components of tubes running along the intermediate spaces opposite one another, with the tube sections between the film hinges and the spring elements being of essentially rigid design.

Another possibility for the design of the film hinges consists of designing the intermediate spaces in the area of the connectors as grooves, with each having the film hinge in its base.

Another possibility of designing the spring elements consists of designing them as bridges between the transverse ribs lying laterally beside the connectors. This results in continuous profiles that are distributed over the length of the tranverse ribs, which is useful for the flow of plastic during the injection molding. Furthermore, the bridges also provide additional mutual stability to the transverse ribs, so that the bridges can also be used when the spring elements are parts of the aforementioned tubes, for example.

When the film hinges are designed with the spring elements as tubes, the rotation-limiting elements can beneficially be designed as projections in the tubes pointing toward one another. When the back rest is bent backward, the projections then strike one another and this limit the relative motion of the transverse ribs.

When the intermediate spaces between the connectors are designed as grooves, they can also suitably be designed so that the grooves are opened on the back face of the back rest and the walls of the grooves form the rotation-limiting elements on the side facing away from the base of the grooves. When the back rest is bent, the grooves are then closed on their side facing away from the base until the walls of the grooves encounter one another.

There is also the possibility of bridging over the grooves on the sides facing away from the film hinges with flexible, essentially unstretchable strips as continuous profiles, that form the rotation-limiting elements in their stretched positions. In this case, the grooves with their bases lie in the connectors in such a way that when the back rest is bent, the grooves open on their side away from the base, which then stretches the strips bridging over the grooves, which then in their stretched position ultimately prevent further bending of the back rest.

These strips can be designed at the same time as spring elements that have an outward bend in their rest position, from which they reach the stretched position under load against their inherent spring stress. In this case, the functions of the spring elements and of the rotation-limiting elements are combined with one another.

The connectors can be made to run in the center of the back rest, so that a type of spine is therefore produced in the back rest, so to speak, but it is also possible to arrange the connectors as a symmetrical pair in the side area of the back rest.

To produce special effects for the anatomical adaptation, the spring stress of the spring elements can be designed differently from one intermediate space to another. For example, it is beneficial to design the spring elements with increasing stiffness from top to bottom along the back rest so that when leaning back, the top section of the back rest first bends back and then the lower sections increasingly.

Figure 9:
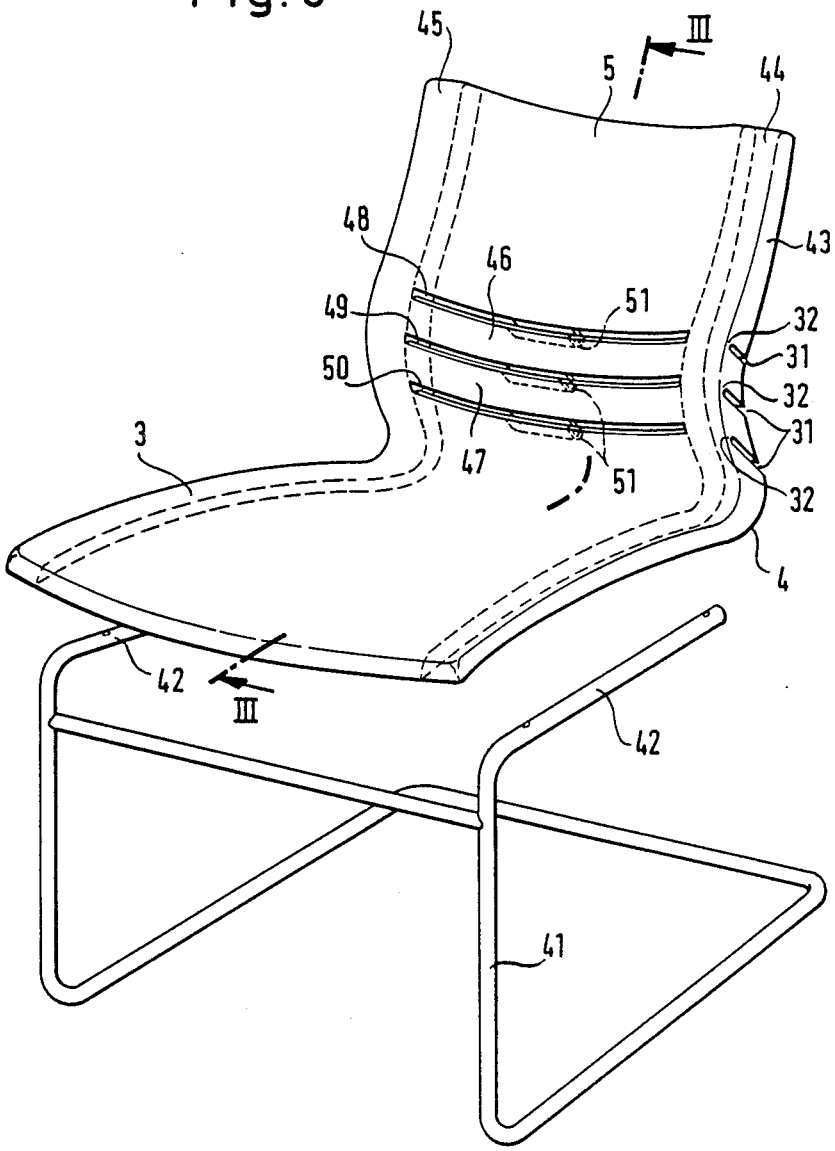
Figure 10:
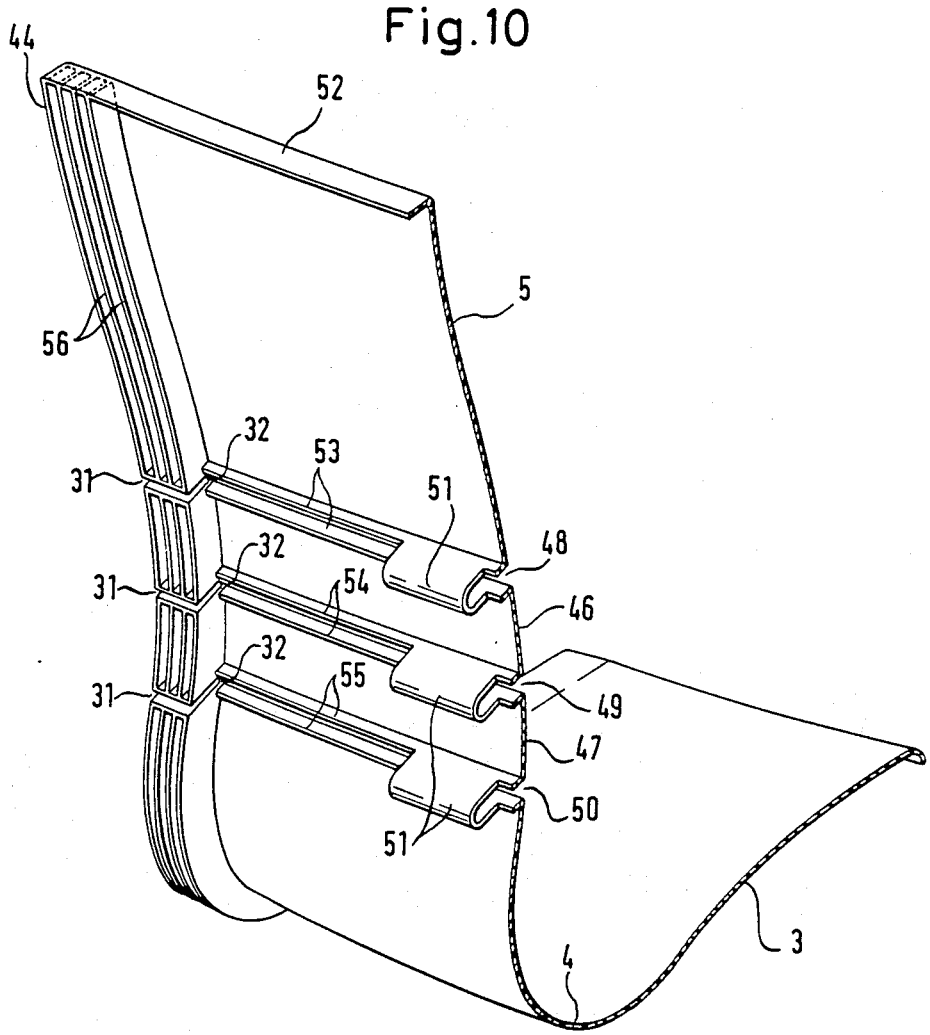

Examples of embodiment of the invention are shown in the Figures. The figures show:

FIG. 1 a perspective view of the chair with connectors n running in the center of the back rest, FIG. 2 a longitudinal section running in the center through the back rest and the seat of the chair of FIG. 1, sectioned along the line I—I in FIG. 1, FIG. 3 the same longitudinal section under a load pointing backward, FIG. 4 a section from the back rest of FIG. 1 in the area of the film hinge and of the spring element, sectioned along the line II—II in FIG. 1, FIG. 5 the same section as FIG. 2 but under load, FIG. 6 a longitudinal section through the back rest and seat with grooves as intermediate spaces between the connectors, in the rest position, FIG. 7 the same section under load in the backward direction, FIG. 8 a top view of the back rest of FIGS. 6 and 7 with bridges lying laterally beside the connectors, as spring elements, FIG. 9 a perspective view of a chair in which the connectors run on the lateral edges of the back rest, FIG. 10 back view of the back rest with seat according to FIG. 9, sectioned along the line III—III from FIG. 9, FIG. 11 a partial back view of the back rest with seat with a different design of a connector, FIG. 12 a side view of the arrangement of FIG. 11 in the rest position, FIG. 13 the same arrangement under load.

FIG. 1 shows the chair in perspective view, with the illustration of the underframe largely omitted. This is the state of the art. The upper part of a swivel frame 1 and a steel pipe frame 2*a* are drawn in. The seat 3 is fastened to the frame 2*a*. In the design shown, this produces an axis of rotation for the seat 3 in a known way approximately in the area of the crossbrace 2*b* of the frame 2*a* in such a way that the seat 3 can spring around the crossbrace 2*b* under load.

The seat 3 changes into the back rest 5 through the rounding area 4, with the back rest being arched in a known way so that its edges 6 and 7 are somewhat pulled forward laterally. The back rest 5 also has a curvature 8 in the longitudinal cross section matching the anatomy of the spinal column. The two transverse ribs 9 and 10 are located in the area of this curvature 8 and are separated from one another and from the adjacent parts of the back rest 5 and the rounded section 4 by the intermediate spaces 11, 12, and 13.

The back rest 5 in the center contains a trough-like depression 14/15 in the center of which runs the web 16 in the longitudinal direction of the back rest, which provides for the necessary stiffness of the back rest 5 in this area. If necessary, several such webs can be arranged side by side. There is a connector 17, 18, and 19 in the area of each of the depressions 14/15 as extensions of the intermediate spaces 11, 12, and 13, which extends over the entire width of the depression 14/15 and also runs through the web 16. The transverse ribs 9 and 10 are held together with the adjacent parts of the back rest 5 and the rounded area 4 with the help of the connectors 17, 18, and 19. The connectors 17, 18, and 19 are designed so that they produce a rotary mobility around horizontal axes in the area of the interspaces 11, 12, and 13, which gives the back rest flexible compliability with which the back rest can adapt to the anatomical features of a seated person leaning back. It should be pointed out here that the back rest 5 with its rounded section 4, the transverse ribs 9 and 10, and the seat 3 in principle constitute rigid structural elements, which is possible directly by choosing a suitable plastic such as polypropylene, for example, and appropriate known reinforcements on the bottom of the seat and the back of the back rest 5. Such reinforcements are shown in FIG. 1 in connection with the back rest; they are reinforcements 20, 21, and 22 that run in the longitudinal direction as extensions of the edges of the depressions 14/15. If needed, further reinforcements can be provide, particularly at the edges 6 and 7 of the back rest 5 and below the seat 3.

With reference to FIGS. 2 and 3, the structural configuration of the connectors 17, 18, and 19 will now be described. FIG. 2 shows a section along the line I—I of FIG. 1, or a longitudinal section running along through the back rest 5, the rounded area 4, and the seat 3, which runs in the center of the web 16. FIG. 2 shows the seat 3 and the back rest 5 in the unloaded position, while FIG. 3 shows the seat and back rest 5 under load.

Because of the arch of the back rest 5, the front surface of the back rest 5 is shown in FIG. 2 at the left beside the sectioned reinforcement 21, up to the edge 7 (see FIG. 1). A corresponding representation is found also in the area of the seat 3, which in a known way likewise has an arch following the anatomy of a seated person. The connectors 17, 18, and 19 shown in FIG. 2 in this case consist of pipes 23, each of which forms the film hinge 24 on the side facing the front of the back rest 5, while the opposite sides of the tubes 23 form the particular spring elements. The areas between them that are adjacent to the web 16 are of rigid design because of this connection to the web 16. The same naturally applies also to the areas of the tubes 23 in which they change over from the depression 14/15 to the adjacent parts of the back rest 5 or of the rounded area 4 and of the transverse ribs 9 and 10. Consequently, when the back rest 5 is loaded, as shown in FIG. 3, only a deformation of the tubes 23 occurs in the area of the film hinges 24 and the spring elements 25. The film hinges 24 undergo a slight buckling away, while the spring elements 25 are bulged outward.

The overall bending of the back rest 5 is relatively slight considering the deformation of the spinal column when a person sitting on the chair leans back. Rotation-limiting elements are provided so that no overloading of the film hinges 24 and of the spring elements 25 now occurs, but for reasons of simplification of the illustration, they are not shown in FIGS. 1 to 3. A form of embodiment of a rotation-limiting element will now be discussed with reference to FIGS. 4 and 5.

FIGS. 4 and 5 each show a tube 23 as in FIGS. 2 and 3 into which extend projections 26 and 27 that act as rotation-limiting elements. The cross sections from FIGS. 4 and 5 along the lines II—II from FIG. 1 are placed here so that the web 16 is drawn as a part visible from the side. According to FIG. 4, there is a separation between the projections 26 and 27, which disappears when the tube 23 is loaded because of the complete approach of the projections 26 and 27, with the projections 26 and 27 striking one another and thus bringing about the limitation of rotation in the area of the tube 23. In FIG. 5, the angle a is also drawn in by which the degree of bending is shown in the area of the tube 23. This is a somewhat exaggerated illustration to show the angle a clearly. As mentioned previously, this is an angle of approximately 3° at the most. It is also apparent from FIG. 5 that the spring element 25 has bulged slightly in comparison with the illustration in FIG. 4, which gives the spring element 25 the necessary restoring force.

It is also clear from FIGS. 2 to 5 that the film hinqes 24 and the spring elements 25 form continuous cross sections for the flow of plastic, particularly in injection molding. There is thus the possibility of molding the seat 3 and the back rest 5 with the associated elements in one piece, with the material being able to spread from the gate point, which may lie beneath the seat 3, for example, over all parts of the seat 3 and the back rest 5.

FIGS. 6 and 7 illustrate cross sections similar to those of FIGS. 2 and 3, but the connectors in particular are of different design. In the illustration and in the identifications of the arrangement pursuant to FIGS. 6 and 7, reference has been made back to the configuration and the reference symbols from FIGS. 1 to 3 as far as possible. However, it should be emphasized that the form of embodiment according to FIGS. 6 and 7 has three transverse ribs 16 (in contrast to two transverse ribs according to FIG. 1). The number of transverse ribs is governed by the desired anatomical adaptation, and optionally by the technical molding capabilities. In the form of embodiment according to FIGS. 6 and 7, the interspaces 34, 35, 36, and 37 lie next to the grooves 31 (one interspace more than in the form of embodiment according to FIG. 1 because only two transverse ribs 9 and 10 are provided there). These interspaces 34, 35, 36, and 37 are bridged over by the bridges 33 constituting spring elements, and they therefore connect the transverse ribs 28, 29, and 30 next to one another and the adjacent sections of the back rest 5 and of the rounded area 4. The bridges 33 according to the rest position shown in FIG. 6 are molded with a sag, so that they permit stretching, by which they produce spring tension. This will be discussed in detail in connection with FIG. 8. When leaning back, the film hinges 32 are slightly bent until they contact the walls 38, 39 (see FIG. 7) of the grooves 31 on the sides facing away from the film hinges 32. In this way, the rotation-limiting element is also provided by the configuration of the grooves.

FIG. 8 shows a top view of a section of the back rest 5, the central area with the grooves 31, and next to them, the area of the back rest with the interspaces 34, 35, and 36 (interspace 37 from FIG. 6 is no longer shown in FIG. 8). The shading drawn in FIG. 8 has been used to represent visible material of the back rest. Beyond this, FIG. 8 contains an upper part and a lower part, separated by the space X left open in the drawing. The lower part shows the back rest in the unloaded state, and the upper part shows the back rest in the loaded state. Accordingly, the bridges 33 drawn in the interspace 36 are shown bent, since they bridge over the interspace 36 under no tension. In the upper part, on the other hand, a loaded back rest is shown, so that the bridges 33 in the interspaces 34 and 35 are shown to be more stretched. In the stretched position shown, the bridges 33 are stressed and exert their desired restoring force in this way. The bridges 33 can also have the task of the rotation-limiting elements, since the bridges 33 in the fully stretched position permit practically no further stretching, by which the limitation of rotation is produced. It is therefore also possible, when grooves 31 are used, to dispense with using the ends of their walls as rotation-limiting elements (see FIG. 7).

It is obvious that the film hinges 32 and the bridges 33 form continuous cross sections for the plastic, so that the seat 3 and the back rest with the associated elements can be molded in one piece over the flow cross sections mentioned in the form of embodiment of FIGS. 6, 7, and 8 also. It should also be pointed out that the box-shaped structures 40 shown in FIG. 8 are ribs formed on the back of the back rest 5 that serve to reinforce the transverse ribs 28, 29, and 30.

FIG. 9 shows another example of embodiment in which the tube frame 41 serves as a supporting frame that permits a certain spring in the seat 3 with its upper spars 42 in a known way. The seat 3 is fastened to the spars 42. In this case, the connectors are located in the area of the back rest at their lateral edges. The connectors consist here essentially of the film hinges 32, that are designed at the base of grooves 31, which in principle in this respect forms a structure according to those from FIG. 6. The grooves 31 in this case are provided in edge reinforcements 44, 45 that appear as boxes open at the back, with the grooves 31 each being provided in a wall 43 of the edge reinforcement 44 or 45 in question. The grooves 31 and the film hinges 32 act like the components with the same identifications in FIGS. 6 to 8.

The two transverse ribs 46 and 47 that are separated from one another by the interspaces 48, 49, and 50 are located in the back rest 5 between the edge reinforcements 44 and 45. The spring elements are located in the area of the interspaces 48, 49, and 50 in the center, as bridges 51 that bulge out on the back side of the back rest. This will be discussed in detail in connection with FIG. 10.

FIG. 10 shows a rear view of the back rest 5 with the seat 3, sectioned along the line III—III from FIG. 9. The back rest 5 is shown here in the unloaded position. A stabilization of the back rest 5 is seen in FIG. 10, by the reinforcements 52, 53, 54, and 55 running across and the reinforcements 56 running longitudinally, which run in the edge reinforcement 44. Naturally, corresponding reinforcements run in the edge reinforcement 45, not shown in FIG. 10

FIG. 11 shows a modification from the example of embodiment according to FIG. 10, with the spring elements and the rotation-limiting elements according to FIG. 11 being placed in the connectors located on the side. The seat 3 and the back rest 5 are shown in FIG. 11, specifically only in part, with the edge reinforcement 45 running along one edge of the seat 3 and the back rest 5 (a corresponding edge reinforcement then lies on the opposite side). In contrast to the form of embodiment of FIG. 10, in which the film hinges 32 are located on the front of the back rest 5, the film hinges 32 in the form of embodiment of FIG. 11 lie on the back of the back rest 5. The film hinges 32 in this case form the vertex of a triangle of surfaces 57 and 58 arranged in the manner of a triangle, which open toward the front in the form of a groove. The surfaces 57 and 58 are braced to one another in the backward direction by the stiffeners 59 that run as extensions of the walls and the stiffener 60 in the edge reinforcement 45. On the side opposite the film hinges 32, the walls 57 and 58 are connected by the strips 61 that are bent slightly inward in the rest position shown in FIG. 11. The strips constitute both the spring elements and the rotation-limiting elements, and their function will be described below with reference to the explanation of FIGS. 12 and 13. The transverse ribs 46 and 47 with the interspaces 48, 49, and 50 extend in lateral extension beside the film hinges 32 with the surfaces 57 and 58.

FIGS. 12 and 13 show in side view a section of the edge reinforcement 45 in the area of a film hinge 32 with the surfaces 57 and 58. FIG. 12 shows the arrangement in the rest position, and FIG. 13 shows the arrangement under load. It is obvious that the strip 61 shown in FIG. 12 is bent slightly inward. It is changed under load into the stretched position shown in FIG. 13, with the change to the stretched position in the strip 61 building up spring tension, with which it deploys the action of the spring element. The strip 61 can practically not be stretched beyond the stretched position shown in FIG. 13, so that in this position it acts as a rotation-limiting element.

With regard to all of the examples of embodiment, it should be pointed out that the overall configuration of the seat 3 and the back rest 5 after removal from the mold can be covered over with cushion foam, on the one hand to make projections from the reinforcements invisible, and also on the other hand to provide cushioning from the outset.

I claim:

1. A chair having a seat, a back, and an inherently elastically compliant back rest in the hip area, said chair comprising:

said back rest being formed of a plurality of transverse ribs, said ribs being separated from one another by interspaces;

a plurality of connectors holding said ribs together and holding said ribs to said seat and said back, said connectors allowing said transverse ribs to rotate around horizontal axes with respect with one another, said connectors being formed of mutually coacting film hinges, spring means and rotation limiting means, said connectors being molded of plastic in one piece over continuous cross-sections together with said seat, said back and said back rest.

2. The chair according to claim 1 further including areas on said film hinges, said areas being connected to said seat, said back rest and said transverse ribs.

3. The chair according to claim 1 wherein said film hinges and said spring means are disposed opposite one another and unite to form tubes in said innerspaces.

4. The chair according to claim 3 wherein said rotation limiting means are projections disposed in said tubes and pointing toward one another.

5. The chair according to any one of claims 1 to 4 wherein said connectors are disposed in the center of the back rest.

6. The chair according to any one of claims 1 to 4 wherein the spring tension of said spring means develops differently from interspace to interspace.

7. The chair according to claims 1 or 2 wherein said interspaces form grooves that are on the back side of said back rest, the walls of said groove forming the rotation limiting means.

8. The chair according to claims 1 or 2 wherein said interspaces form grooves; and flexible, essentially inextensible strips of continuous cross-sections bridging said grooves, and forming in their stretched position, the rotation limiting means.

9. The chair according to claim 8 wherein said strips further constitute said spring elements, said strips having a bulge in their rest position from which they reach the stretched position against an inherent spring tension.

* * * * *